United States Patent [19]

Nawrot

[11] Patent Number: 4,599,830

[45] Date of Patent: Jul. 15, 1986

[54] ENERGY SAVING BUILDING AND METHOD OF CONSTRUCTING SAME

[76] Inventor: James Nawrot, P.O. Box 152, Gaylord, Mich. 49735

[21] Appl. No.: 617,105

[22] Filed: Jun. 4, 1984

[51] Int. Cl.[4] ..... E04B 7/02

[52] U.S. Cl. ..... 52/90; 52/94; 52/293; 52/92; 52/426

[58] Field of Search ..... 52/90, 92, 408, 410, 52/262, 265, 268, 269, 93, 712, 292, 293, 274, 94, 169.14, 236.3, 336.6, 426, 741

[56] References Cited

U.S. PATENT DOCUMENTS

| | | | |
|---|---|---|---|
| 1,007,871 | 11/1911 | Horton | 52/92 |
| 1,082,937 | 12/1913 | Douglass | 52/90 |
| 1,256,393 | 2/1918 | Thomas | 52/92 |
| 2,372,200 | 3/1945 | Hayes | 52/293 |
| 2,477,163 | 7/1949 | Barnett | 403/205 |
| 2,864,251 | 12/1958 | Imbrogno et al. | 52/236.6 |
| 2,899,771 | 8/1959 | Burris, Jr. | 52/169.14 |
| 3,256,030 | 6/1966 | Banse | 52/712 X |
| 3,438,163 | 4/1969 | Vevoda | 52/268 X |
| 3,754,362 | 8/1973 | Daimler et al. | 52/169.14 X |
| 4,087,949 | 5/1978 | Hill | 52/92 X |
| 4,313,688 | 2/1982 | Daniels | 57/712 X |
| 4,372,089 | 2/1983 | Akesson | 52/94 X |
| 4,471,590 | 9/1984 | Roberts et al. | 52/426 X |

*Primary Examiner*—William F. Pate, III
*Assistant Examiner*—Creighton Smith
*Attorney, Agent, or Firm*—Michael L. Bauchan

[57] ABSTRACT

A building and method of constructing same is provided which utilizes a substantially continuous vapor barrier enclosing two or more stories of a building. The second story floor joist assembly is supported on an inner wall assembly in the first story. A roof assembly which covers the entire building is supported on an outer wall assembly in the first story. A continuous vapor barrier encloses the inner wall assembly and all living areas and is positioned between the inner wall assembly and the outer wall assembly. A truss shoe and tie plate connect the outer wall assembly to the inner wall assembly through the vapor barrier so as to maintain a predetermined spaced relationship between the inner wall assembly and the outer wall assembly.

16 Claims, 14 Drawing Figures

ENERGY SAVING BUILDING AND METHOD OF CONSTRUCTING SAME

BACKGROUND OF THE INVENTION

This invention relates to a building and method of constructing same. The building is of an energy saving design and incorporates a substantially continuous vapor barrier that encloses the entire living area of the building.

Buildings such as residences are commonly constructed in a manner referred to as being of a frame construction. Construction techniques common in the construction industry do not tightly seal the inner living area of a building with a vapor barrier. The importance of a tight vapor barrier seal is widely recognized. For example, Akesson U.S. Pat. No. 4,372,089 is a U.S. Patent of a building and method of constructing same which attempts to provide a tight construction. Bentley U.S. Pat. No. 3,969,860 is another U.S. Patent on a building intended to have good thermal efficiency intended to save energy.

The aforementioned building designs and those in common practice do not provide a total and continuous seal of an entire living area with a vapor barrier. The construction techniques as a practical matter necessitate openings in the vapor barrier and each opening interrupts the desired airtight seal.

SUMMARY OF THE INVENTION

According to the present invention, a building and method of constructing same has been devised whereby a substantially continuous vapor barrier encloses the entire usable volume of a building. This has been accomplished by utilizing a double wall construction design and assembly method. A conventional foundation of wood or concrete is first erected. An inner wall assembly is erected on the foundation within which comprises the living area. A second floor joist assembly is positioned on the inner wall assembly, which supports it. The inner wall assembly and second floor joist assembly are enclosed with a substantially continuous vapor barrier. An outer wall assembly is erected outside the vapor barrier on the foundation. The top of the outer wall assembly is connected through the vapor barrier to the top of the inner wall assembly utilizing a unique truss receiving shoe. A roof assembly comprised of trusses is erected over both the inner and outer wall assemblies so that the roof assembly trusses are supported by truss shoes in such a manner that the roof assembly is totally supported by the outer wall assembly. The truss shoes and tie plates maintain the outer wall assembly a predetermined distance from the inner wall assembly and both wall assemblies and the roof assembly are filled with insulation.

DESCRIPTION OF THE PREFERRED EMBODIMENT

Figure 1:
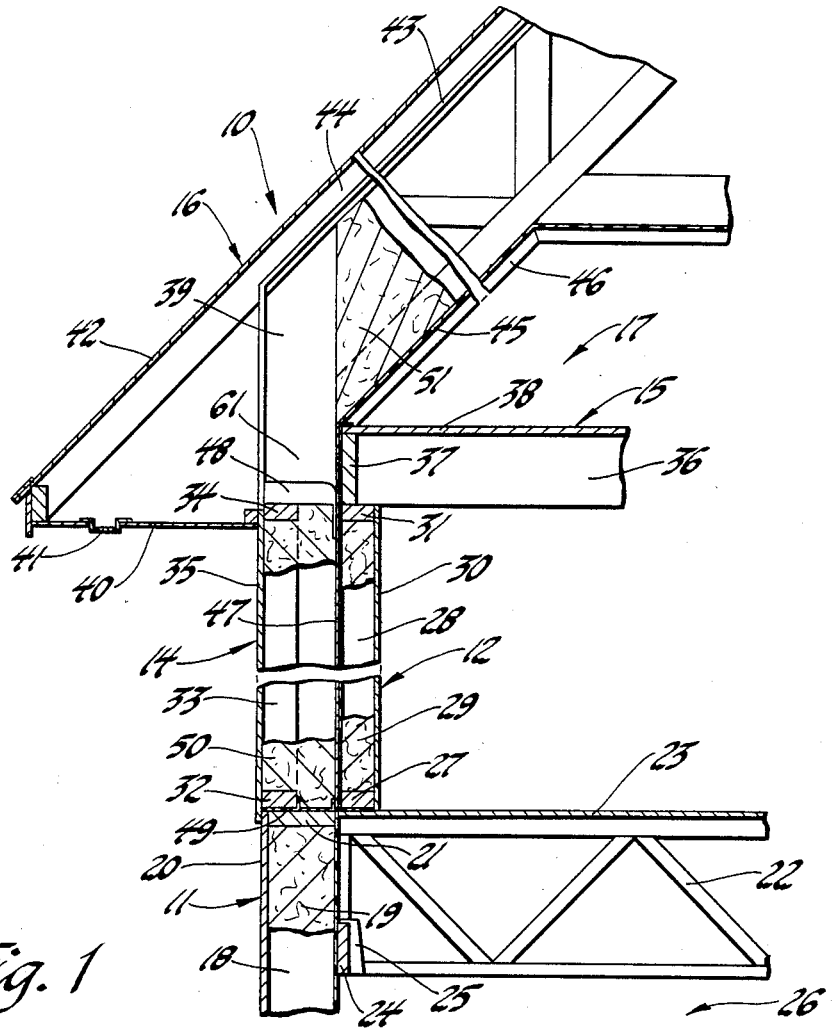
FIG. 1 is a vertical section of a building which embodies the subject design and is constructed according to the subject method.

In FIG. 1 a building 10 embodying the principles of the subject invention is illustrated in partial sectional view. The building 10 is of a frame construction of a conventional configuration other than as pertains to the unique elements which will be set forth herein. Persons versed in the art will therefore appreciate that based upon the illustration in FIG. 1 and the accompanying drawings and the following description the portions of the building 10 not specifically illustrated in detail will be apparent to persons versed in the art.

The building 10 includes a foundation assembly 11 which is supported by the ground (not shown). An inner wall assembly 12 is supported by the foundation assembly 11. The inner wall assembly 12 surrounds and defines an open area which is commonly referred to as first story living area 13. The foundation assembly 11 also supports an outer wall assembly 14 which persons versed in the art will appreciate surrounds the inner wall assembly 12.

A second story floor joist assembly 15 is supported by the inner wall assembly 12. A roof assembly 16 is supported by the outer wall assembly 14 so as to completely cover the inner wall assembly 12, the outer wall assembly 14 and the second story floor joist assembly 15. The roof assembly 16 and the second story floor joist assembly 15 cooperate to define an open area commonly referred to as the second story living area 17.

The materials used in construction of the building 10 are commonly found in frame residences. They are made into unique objects which are utilized to practice the subject invention, as will now be explained.

The foundation assembly 11 in the illustrated embodiment includes a series of 2″×8″ studs 18 chemically treated to resist rot and insects. Between the studs 18 is a thick layer of fiberglass insulation 19 secured to the studs 18 in a conventional manner. A layer of plywood 20 which has also been chemically treated covers the outside of the studs 18. A 2″×8″ wood top foundation plate 21 connects the top of the studs 18. The foundation assembly 11 also includes a first story floor truss assembly 22 which is covered with a first story floor 23 and is supported by a 2″×6″ wood ledger board 24 which is secured to studs 18 and which in turn supports a joist hanger 25. Beneath the first story truss assembly 22 a living area is defined which is commonly called a basement 26.

The inner wall assembly 12 includes an inner wall bottom plate 27 made of 2"×4" wood on which are erected an array of vertical inner wall studs 28 which are also of 2"×4" construction. Between studs 28 is a 3½" thick layer of fiberglass insulation which is covered on the inside by a suitable inner wall 30 which may be of plasterboard or paneling. The top ends of studs 28 are connected by an inner wall top plate 31 which is also 2"×4" wood.

The outer wall assembly 14 includes an outer wall bottom plate 32, a vertical array of outer wall studs 33 and an outer wall top plate 34 which connects the upper ends of the outer wall studs 33. An outer wall 35 is provided which may be of suitable plywood with an exterior covering of a conventional decorative siding.

The second story floor joist assembly 15 includes an array of parallel joists 36 connected by cross-member 37, all of which may be 2"×10" wood construction, covered by a second story floor 38 which may be of plywood.

The roof assembly 16 includes a prefabricated truss assembly 39 of a conventional configuration. Roof assembly 16 includes an overhanging eave 40 provided with a vent 41, a plywood roof 42 which may be covered with suitable shingles in the conventional manner, and cardboard 43 for purposes of maintaining a ventilation airway 44.

A substantially continuous vapor barrier 45 is provided of a material commonly used in the construction of buildings. While polyethylene film is a common moisture or vapor barrier, hereafter the component will simply be referred to as the vapor barrier. The vapor barrier 45 is secured to the roof assembly 16 by various 2"×2" nailer members 46 which may be covered with a suitable ceiling or paneling material.

The vapor barrier 45 completely encloses both the first story living area 13 and the second story living area 17. From the roof assembly 16 the vapor barrier us extends down between the inner wall assembly 12 and the outer wall assembly 14 so as to completely enclose inner wall assembly 12 and the second story floor joist assembly 15. At the bottom of the inner wall assembly 12 the vapor barrier 45 extends between the first story floor truss assembly 22 and studs 18 so it also surrounds the basement 26 as it extends to the opposite wall.

Persons versed in the art will appreciate that vapor barrier 45 is not commercially available in a sufficient size as a practical matter to completely enclose a house or other building in a single sheet. The vapor barrier 45 is therefore obtained in the largest roll commercially available and during construction of the building 10 it is unrolled, preferrably in a vertical direction, and positioned as shown in FIG. 1 with any edges overlapped by other sections of vapor barrier 45, which preferrably are sealed by means of a suitable glue or caulking compound so that when the building 10 is constructed vapor barrier 45 is substantially a continuous vapor barrier which completely surrounds the living areas 13 and 17 and the basement 26 except for the usual doors and windows and these openings are also sealed as tightly as possible in the usual manner.

As shown in FIG. 1, in the preferred embodiment a thin plywood sheet 47 is secured to the exterior side of the vapor barrier 45 by nailing sheet 47 through the vapor barrier 45 into studs 28 so that the interior surface of the vapor barrier 45 faces insulation 29.

Figure 3:
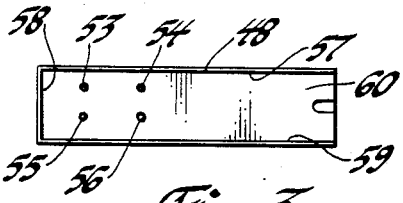
FIG. 3 is a top view of the truss shoe in FIG. 2 taken along lines 3—3.
Figure 2:
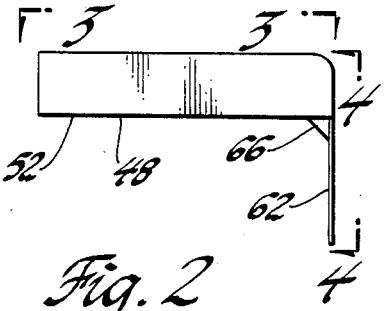
FIG. 2 is an enlarged plan view of a truss shoe shown in FIG. 1.
Figure 4:
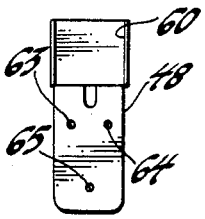
FIG. 4 is an end view of the truss shoe in FIG. 2 taken along lines 4—4.

In the preferred embodiment an array of truss shoes 48 are provided for connecting the top of outer wall assembly 14 to the top of inner wall assembly 12 through the vapor barrier 45. In FIGS. 2 through 4 the detail of each truss shoe 48 is illustrated.

Figure 11:
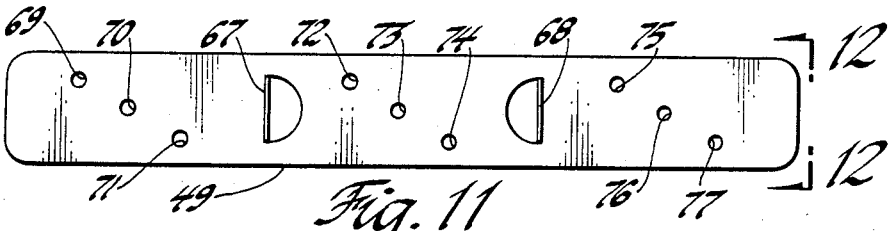
FIG. 11 is a top view of the bottom wall tie plate in FIG. 10 taken along lines 11—11.
Figure 10:
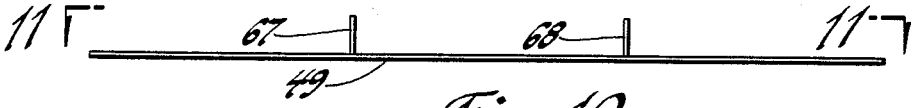
FIG. 10 is an enlarged plan view of a bottom wall tie plate shown in FIG. 5.
Figure 12:
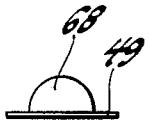
FIG. 12 is an end view of the bottom wall tie plate in FIG. 10 taken along lines 12—12.

The bottom of outer wall assembly 14 is secured to the bottom of inner wall assembly 12 through vapor barrier 45 by means of a bottom wall tie plate 49 which is described in detail in FIGS. 10 through 12. Truss shoe 48 and tie plate 49 keep outer wall assembly 14 a predetermined distance at top and bottom, respectively, from inner wall assembly 12. The space between outer wall 35 and vapor barrier 45 is filled with cellulose or other suitable blown or poured insulation to form a blanket 50. A similar insulation blanket 51 is provided in the roof assembly 16 by filling the entire area between cardboard 43 and vapor barrier 45 between the truss assembly 39.

As shown in FIGS. 2 through 4, truss shoe 48 includes a first flange 52 provided with a series of holes 53 between the sides of 57–59 of a truss receiving channel 60 adapted to receive a lower end 61 of the vertical member of truss 39.

Truss shoe 48 is provided with a second flange 62 in which are provided holes 63–65 through which nails can be driven through vapor barrier 45 into inner wall studs 28. A reinforcing crease 66 is also provided in truss shoe 48. It is thus apparent that truss shoe 48 when nailed to outer wall top plate 34 and inner wall top plate 31 and inner wall studs 28 provides a very rigid connection between outer wall assembly 14 and inner wall assembly 12.

As shown in FIGS. 10–12, bottom wall tie plate 49 is provided with two vertical flanges 67–68 and holes 69–77 through which nails can be driven to secure tie plate 49 to the bottom ends of outer wall assembly 14 and inner wall assembly 12.

Figure 7:
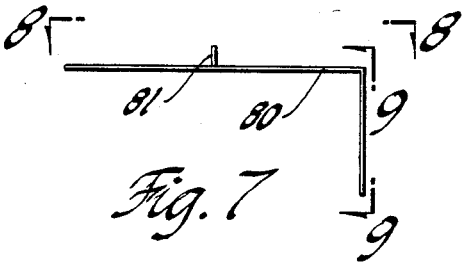
FIG. 7 is an enlarged plan view of a side wall tie plate illustrated in FIG. 5.
Figure 9:
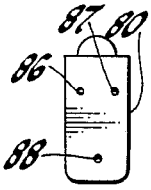
FIG. 9 is an end view of the side wall tie plate shown in FIG. 7 taken along lines 9—9.
Figure 8:
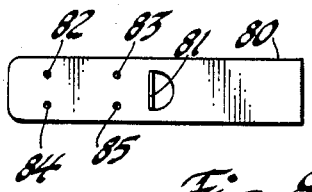
FIG. 8 is a top view of the side wall tie plate in FIG. 7 taken along lines 8—8.
Figure 5:
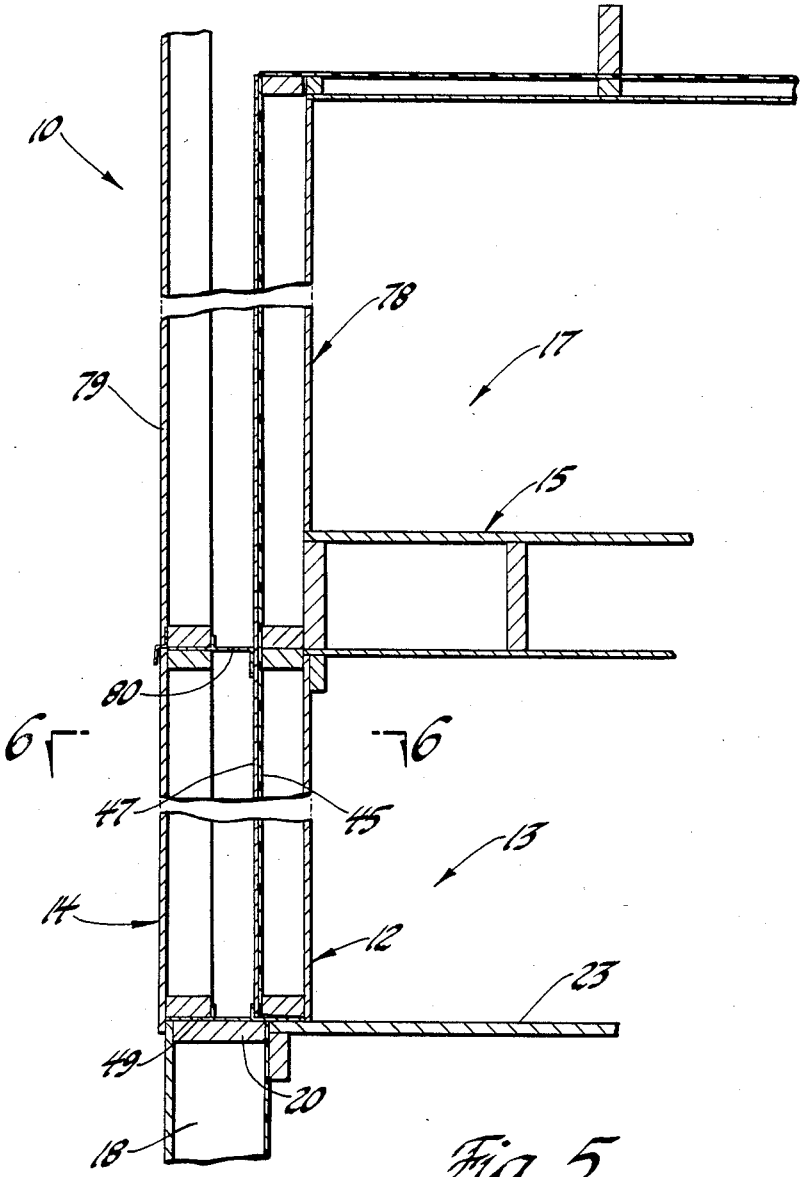
FIG. 5 is a vertical section view of an alternative embodiment of the building shown in FIG. 1.

In FIG. 5 an alternative embodiment of the building 10 in FIG. 1 is illustrated to show how the basic design in FIG. 1 can be incorporated in a taller structure. As shown in FIG. 5, a simplified first story floor 23 is illustrated with inner wall assembly 12 connected at the bottom end to the bottom end of outer wall assembly 14 by means of bottom wall tie plate 49 in the manner just described. However, since the structure of building 10 in FIG. 5 is taller than the structure of building 10 in FIG. 1 the inner wall assembly 12 in FIG. 5 supports a second story inner wall assembly 78 which is similar to the inner wall assembly 12. The outer wall assembly 14 in FIG. 5 supports a second story outer wall assembly 79 which is similar in structure to the outer wall assembly 14 in FIG. 5. A side wall tie plate 80 is provided in FIG. 5 to rigidly maintain inner wall assembly 12 a predetermined distance from outer wall assembly 14 and second story inner wall assembly 78 a predetermined distance from second story outer wall assembly 79. FIGS. 7–9 illustrate in detail the construction of side wall tie plate 80. As shown in FIGS. 7–9, side wall tie plate 80 is provided with a vertical flange 81 and holes 82–85 for attachment to outer wall assembly 14 and holes 86–88 for attachment to inner wall assembly 12. Flange 81 abuts the end of second story outer wall assembly 79, which is securely fastened to the top of outer wall assembly 14, to maintain the predetermined distance desired between the inner and outer wall assemblies 12 and 14 and 78 and 79 in FIG. 5.

Figure 6:
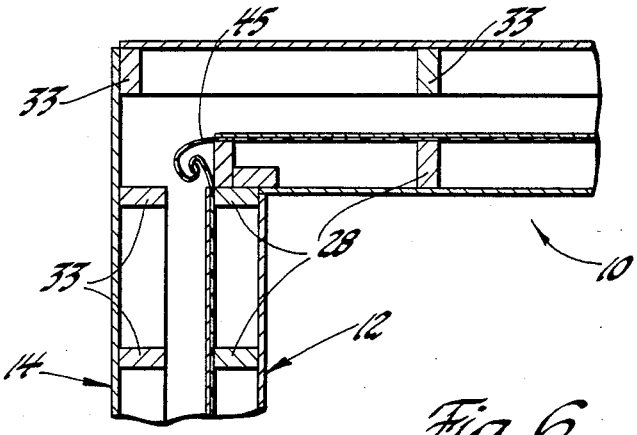
FIG. 6 is a horizontal section view of the building in FIG. 5 taken along lines 6—6.

FIG. 6 is a horizontal cross-section view of the apparatus in FIG. 5 presented to illustrate how the inner wall assembly 12 is held a predetermined distance from outer wall assembly 14 even at the corner of building 10 and the vapor barrier 45 is overlapped at the corner and securely glued so as to provide a tight vapor barrier.

It is thus apparent that the building 10 uses a unique double wall construction in which the inner wall assembly 12 is rigidly maintained a predetermined distance from the outer wall assembly 14 and the inner wall assembly 12 supports the second story floor joist assembly and such other internal living areas and structures as are deemed appropriate within a totally enclosed vapor barrier 45 while the outer wall assembly 14 bears the entire weight of the roof assembly 16 outside the sealed enclosure provided by vapor barrier 45 and the particular arrangement and placement of truss shoes 48 and bottom wall tie plates 49 and side wall tie plates 80 maintain the required rigidity between the various inner and outer walls not only on the first story but also in the second story and basement.

Figure 13:
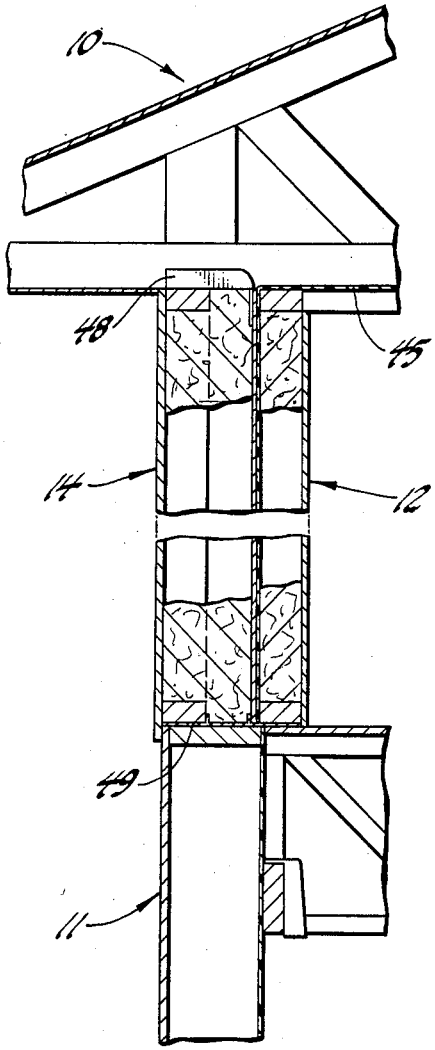
FIG. 13 is a vertical cross-section of an alternative embodiment of the building in FIG. 1.

In FIG. 13 an alternative embodiment is provided of building 10 illustrating how the aforementioned components can be employed in a ranch style residence which is similar to that provided in FIG. 1 but the second story living area 17 has been omitted with the result that the vapor barrier 45 makes a 90° bend at the top of inner wall assembly 12.

Figure 14:
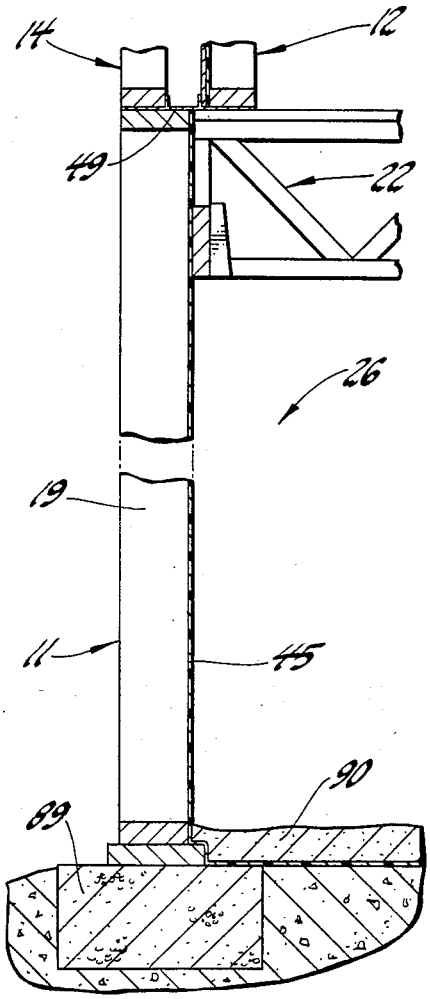
FIG. 14 is a vertical cross-section of an alternative embodiment of the building in FIG. 13.

In FIG. 14 an alternative embodiment of FIG. 1 is presented showing how the vapor barrier 45 can be extended down the entire length of the foundation assembly 11 to a conventional footing 89 which may be of concrete or stone and then turned 90° so as to run under the floor 90 of the basement 26 regardless whether the floor 90 is made of loose material such as sand or a rigid material such as poured concrete. Thus the vapor barrier 45 can be extended to the opposite side of building 10 both at the top and bottom of the building so that it completely encloses all of the living area within the building.

It is thus apparent that a unique energy saving building can be erected by following the construction steps of erecting a suitable foundation assembly 11, mounting a bottom wall tie plate 49 on top of foundation assembly 11, erecting an inner wall assembly 12 on top of bottom wall tie plate 49, installing a second story floor joist assembly 15 so it is supported by inner wall assembly 12, surrounding the entire living area with a vapor barrier 45 which extends through the foundation assembly 11 between the first story floor truss assembly 22 and foundation studs 18, installing outer wall assembly 14 on bottom wall tie plate 49, securing inner wall assembly 12 to outer wall assembly 14 at the top with a suitable truss shoe 48, rigidly securing the junction between inner wall assemblies 12 and 78 and the junction between outer wall assemblies 14 and 79 with suitable side wall tie plates 80, and installing a roof assembly 16 on the outer wall assemblies 14 and 79 so that the roof assembly 16 is fully supported by the outer wall assemblies 14 and 79 without any significant portion of the roof assembly 16 weight being supported by inner wall assemblies 12 and 78.

This method of construction as persons versed in the art will appreciate can be modified as to its sequence. For example, the step of surrounding the entire living area with vapor barrier 45 may be performed in part simultaneous with the erecting of a suitable foundation assembly 11 with the vapor barrier 45 extending through it as part of the first step. In a ranch home which does not employ the side wall tie plate 80 some steps could also be eliminated.

What is claimed is:

1. An energy saving building, comprising, in combination, a ground supported foundation assembly, said foundation assembly including a first story floor; an inner wall assembly supported by said foundation assembly; a second floor joist assembly supported by said inner wall assembly; an outer wall assembly spaced a predetermined distance from said inner wall assembly so as to substantially surround said inner wall assembly; a roof assembly supported by said outer wall assembly so as to substantially cover said inner wall assembly; a substantially continuous vapor barrier having outside and inside surfaces positioned so as to separate said inner wall assembly said second floor joist assembly from both said outer wall assembly and said roof assembly, said vapor barrier being positioned so that not more than one-third of the R-factor which separates the inner atmosphere inside said building from the outer atmosphere outside said building is situated inside said vapor barrier; and connection means for securing said outer wall assembly both to said roof assembly and also through said vapor barrier to said inner wall assembly whereby said outer wall assembly supports said roof assembly in a predetermined position outside of said vapor barrier and said inner wall assembly supports said second floor joist assembly inside said vapor barrier and said vapor barrier is inside the dew point between said inner atmosphere and said outer atmosphere.

2. The building of claim 1 in which said connection means includes a first substantially horizontal flange which is attached to said outer wall assembly and is positioned between said outer wall assembly and said roof assembly so as to support said roof assembly on said outer wall assembly and said connection means also includes a second flange attached to said inner wall assembly through said vapor barrier.

3. The building of claim 1 in which said roof assembly includes at least one roof truss and said connection means includes at least one truss shoe, said truss shoe including a substantially horizontal flange attached to said outer wall assembly and positioned between said outer wall assembly and said truss, a truss receiving channel for supporting said truss, and another flange proximate said vapor barrier, and said connection means also including attachment means which extend through said vapor barrier and attach said other truss shoe flange to said inner wall assembly so as to hold said inner wall assembly a predetermined distance from said outer wall assembly.

4. The building of claim 1 in which said foundation assembly includes a foundation wall, a first story floor truss assembly, means for connecting said first story floor truss assembly to said foundation wall through said vapor barrier so as to support said first floor joist assembly on said foundation assembly inside said vapor barrier, and a bottom tie plate positioned outside said vapor barrier, said bottom tie plate including a first flange positioned between said outer wall assembly and said foundation wall so as to support said outer wall on said foundation wall and a second flange connected through said vapor barrier to said inner wall assembly and said first story floor truss assembly so as to support said inner wall assembly on said first story floor truss assembly and said foundation wall.

5. A building comprising, in combination, a foundation assembly which substantially defines a building perimeter; a first story supported by said foundation assembly, said first story including a floor, an inner wall assembly supported by said foundation assembly and an outer wall assembly supported by said foundation assembly substantially surrounding said inner wall assembly; a second story supported by said first story, said second story including a second story floor, a second story inner wall assembly and a second story outer wall assembly substantially surrounding said second story inner wall assembly, said second story inner wall assembly being supported by said first story inner wall assembly and said second story outer wall assembly being supported by said first story outer wall assembly; a substantially continuous vapor barrier which substantially encloses said first and second story inner wall assemblies and which is substantially surrounded by said first and second story outer wall assemblies, said vapor barrier being positioned so that not more than one-third of the R-factor which separates the inner atmosphere inside said building from the outer atmosphere outside said building is situated inside said vapor barrier; a bottom wall tie plate; means connecting said bottom wall tie plate to said first story inner and outer wall assemblies and to said foundation; a side wall tie plate; means connecting said side wall tie plate to at least one of said outer wall assemblies and to at least one of said inner wall assemblies proximate the junction between said first and second stories; a roof assembly for covering said inner and outer walls, said roof assembly including at least one truss; and at least one truss shoe for receiving said truss so as to support said roof assembly on said second story outer wall assembly and for connecting said roof assembly to both said second story inner wall assembly and to said second story outer wall assembly whereby said bottom wall tie plate, said side wall tie plate and said truss shoe rigidly hold said inner wall assemblies in a fixed position at a predetermined distance from said outer wall assemblies and so said vapor barrier extends through said predetermined distance so as to prevent air and vapor passage between said inner wall and said outer wall and said vapor barrier is inside the dew point between said inner atmosphere and said outer atmosphere.

6. A method for constructing a building comprising the steps of erecting a foundation assembly; erecting an inner wall assembly supported by said foundation assembly; positioning a second floor joist assembly on said inner wall assembly; enclosing said inner wall assembly and said second floor joist assembly with a substantially continuous vapor barrier, said vapor barrier being positioned so that not more than one-third of the R-factor which separates the inner atmosphere inside said building from the outer atmosphere outside said building is situated inside said vapor barrier; erecting an outer wall assembly on said foundation; connecting the top of said outer wall assembly through said vapor barrier to the top of said inner wall assembly with a truss receiving shoe; erecting a roof assembly having at least one truss on said outer wall assembly so that said truss is received and supported by said truss shoe and said roof assembly substantially covers said vapor barrier and is supported by said outer wall assembly and said outer wall assembly is maintained at a predetermined distance from said inner wall assembly by said truss shoe and said vapor barrier is inside the dew point between said inner atmosphere and said outer atmosphere.

7. The method of claim 6 in which said method includes the additional steps after said second floor joist assembly is positioned on said inner wall assembly of securing a second inner wall assembly on said first inner wall assembly so as to be thereby supported and after erecting said outer wall assembly a second outer wall assembly is positioned on top of said first outer wall assembly and before connecting said outer wall assembly to the top of said first inner wall assembly a step is inserted of connecting said inner walls and outer walls with a side wall tie plate extending through said vapor barrier.

8. An energy saving building, comprising, in combination, a ground supported foundation assembly, said foundation assembly including a first story floor; an inner wall assembly supported by said foundation assembly; a second floor joist assembly supported by said inner wall assembly; an outer wall assembly spaced a predetermined distance from said inner wall assembly so as to substantially surround said inner wall assembly; a roof assembly supported by said outer wall assembly so as to substantially cover said inner wall assembly; a substantially continuous vapor barrier having outside and inside surfaces positioned so as to separate said inner wall assembly and said second floor joist assembly from both said outer wall assembly and said roof assembly said vapor barrier being positioned so that not more than one-third of the R-factor which separates the inner atmosphere inside said building from the outer atmosphere outside said building is situated inside said vapor barrier; and connection means for securing said outer wall assembly both to said roof assembly and also through said vapor barrier to said inner wall assembly, said inner and outer wall assemblies not being connected in a thermally conductive manner; whereby said outer wall assembly supports said roof assembly in a predetermined position outside of said vapor barrier and said inner wall assembly supports said second floor joist assembly inside said vapor barrier and said vapor barrier is inside the dew point between said inner atmosphere and said outer atmosphere.

9. The building of claim 8 in which said connection means includes a first substantially horizontal flange which is attached to said outer wall assembly and is positioned between said outer wall assembly and said roof assembly so as to support said roof assembly on said outer wall assembly and said connection means also includes a second flange attached to said inner wall assembly through said vapor barrier.

10. The building of claim 8 in which said roof assembly includes at least one roof truss and said connection means includes at least one truss shoe, said truss shoe including a substantially horizontal flange attached to said outer wall assembly and positioned between said outer wall assembly and said truss, a truss receiving channel for supporting said truss, and another flange proximate said vapor barrier, and said connection means also including attachment means which extend through said vapor barrier and attach said other truss shoe flange to said inner wall assembly so as to hold inner wall assembly a predetermined distance from said outer wall assembly.

11. The building of claim 8 in which said foundation assembly includes a foundation wall, a first story floor truss assembly, means for connecting said first story floor truss assembly to said foundation wall through said vapor barrier so as to support said first floor joist assembly on said foundation assembly inside said vapor barrier, and a bottom tie plate positioned outside said vapor barrier, said bottom tie plate including a first flange positioned between said outer wall assembly and said foundation wall so as to support said outer wall on said foundation wall and a second flange connected through said vapor barrier to said inner wall assembly and said first story floor truss assembly so as to support said inner wall assembly on said first story floor truss assembly and said foundation wall.

12. A building comprising, in combination, a foundation assembly which substantially defines a building perimeter; a first story supported by said foundation assembly, said first story including a floor, an inner wall assembly supported by said foundation assembly and an outer wall assembly supported by said foundation assembly substantially surrounding said inner wall assembly; a second story supported by said first story, said second story including a second story floor, a second story inner wall assembly and a second story outer wall assembly substantially surrounding said second story inner wall assembly, said second story inner wall assembly being supported by said first story inner wall assembly and said second story outer wall assembly being supported by said first story outer wall assembly; a substantially continuous vapor barrier which substantially encloses said first and second story inner wall assemblies and which is substantially surrounded by said first and second story outer wall assemblies, said vapor barrier being positioned so that not more than one-third of the R-factor which separates the inner atmosphere inside said building from the outer atmosphere outside said building is situated inside said vapor barrier; a bottom wall tie plate; means connecting said bottom wall tie plate to said first story inner and outer wall assemblies and to said foundation; a side wall tie plate; means connecting said side wall tie plate to at least one of said outer wall assemblies and to at least one of said inner wall assemblies proximate the junction between said first and second stories; a roof assembly for covering said inner and outer walls, said roof assembly including at least one truss; and at least one truss shoe for receiving said truss so as to support said roof assembly on said second story outer wall assembly and for connecting said roof assembly to both said second story inner wall assembly and to said second story outer wall assembly, said inner and outer wall assemblies not being connected in a thermally conductive manner; whereby said bottom wall tie plate, said side wall tie plate and said truss shoe rigidly hold said inner wall assemblies in a fixed position at a predetermined distance from said outer wall assemblies and so said vapor barrier extends through said predetermined distance so as to prevent air and vapor passage between said inner wall and said outer wall and said vapor barrier is inside the dew point between said inner atmosphere and said outer atmosphere.

13. A method for constructing a building comprising the steps of erecting a foundation assembly; erecting an inner wall assembly supported by said foundation assembly; positioning a second floor joist assembly on said inner wall assembly; enclosing said inner wall assembly and said second floor joist assembly with a substantially continuous vapor barrier, said vapor barrier being positioned so that not more than one-third of the R-factor which separates the inner atmosphere inside said building from the outer atmosphere outside said building is situated inside said vapor barrier; erecting an outer wall assembly on said foundation; connecting the top of said outer wall assembly through said vapor barrier to the top of said inner wall assembly with a truss receiving shoe, said inner and outer wall assemblies not being connected in a thermally conductive manner; erecting a roof assembly having at least one truss on said outer wall assembly so that said truss is received and supported by said truss shoe and said roof assembly substantially covers said vapor barrier and is supported by said outer wall assembly and said outer wall assembly is maintained at a predetermined distance from said inner wall assembly by said truss shoe and said vapor barrier is inside the dew point between said inner atmosphere and said outer atmosphere.

14. The method of claim 13 in which said method includes the additional steps after said second floor joist assembly is positioned on said inner wall assembly of securing a second inner wall assembly on said first inner wall assembly so as to be thereby supported and after erecting said outer wall assembly a second outer wall assembly is positioned on top of said first outer wall assembly and before connecting said outer wall assembly to the top of said first inner wall assembly a step is inserted of connecting said inner walls and outer walls with a side wall tie plate extending through said vapor barrier.

15. An energy saving building comprising, in combination, a ground supported foundation assembly, said foundation assembly including a first story floor; an inner wall assembly supported by said foundation assembly; a second floor joist assembly supported by said inner wall assembly; an outer wall assembly spaced a predetermined distance from said inner wall assembly so as to substantially surround said inner wall assembly; a roof assembly supported by said outer wall assembly so as to substantially cover said inner wall assembly; a substantially continuous vapor barrier having outside and inside surfaces positioned so as to separate said inner wall assembly and said second floor joist assembly from both said outer wall assembly and said roof assembly; and connection means for securing said outer wall assembly both to said roof assembly and also through said vapor barrier to said inner wall assembly whereby said outer wall assembly supports said roof assembly in a predetermined position outside of said vapor barrier and said inner wall assembly supports said second floor joist assembly inside said vapor barrier, said connection means including a first substantially horizontal flange which is attached to said outer wall assembly and is positioned between said outer wall assembly and said roof assembly so as to support said roof assembly on said outer wall assembly and said connection means also including a second flange attached to said inner wall assembly through said vapor barrier.

16. An energy saving building comprising, in combination, a ground supported foundation assembly, said foundation assembly including a first story floor; an inner wall assembly supported by said foundation assembly; a second floor joist assembly supported by said inner wall assembly; an outer wall assembly spaced a predetermined distance from said inner wall assembly so as to substantially surround said inner wall assembly; a roof assembly supported by said outer wall assembly so as to substantially cover said inner wall assembly; a substantially continuous vapor barrier having outside and inside surfaces positioned so as to separate said inner wall assembly and said second floor joist assembly from both said outer wall assembly and said roof assembly; and connection means for securing said outer wall assembly both to said roof assembly and also through said vapor barrier to said inner wall assembly whereby said outer wall assembly supports said roof assembly in a predetermined position outside of said vapor barrier and said inner wall assembly supports said second floor joist assembly inside said vapor barrier, said roof assembly including at least one roof truss and said connection means including at least one truss shoe, said truss shoe including a substantially horizontal flange attached to said outer wall assembly and positioned between said outer wall assembly and said truss, a truss receiving channel for supporting said truss, and another flange proximate said vapor barrier, and said connection means also including attachment means which extend through said vapor barrier and attach said other truss shoe flange to said inner wall assembly so as to hold said inner wall assembly a predetermined distance from said outer wall assembly.

* * * * *

UNITED STATES PATENT AND TRADEMARK OFFICE

CERTIFICATE OF CORRECTION

PATENT NO. : 4,599,830

DATED : July 15, 1986

INVENTOR(S) : James Nawrot

It is certified that error appears in the above-identified patent and that said Letters Patent is hereby corrected as shown below:

Column 3, line 40, change "us" to ---45---.

Column 6, line 16, after "inner wall assembly" insert ---and---.

Signed and Sealed this

Sixteenth Day of December, 1986

*Attest:*

DONALD J. QUIGG

*Attesting Officer* *Commissioner of Patents and Trademarks*